US008205881B2

(12) United States Patent
Terada

(10) Patent No.: US 8,205,881 B2
(45) Date of Patent: Jun. 26, 2012

(54) SHEET FEEDING DEVICE, IMAGE RECORDING APPARATUS AND SHEET FEEDING AMOUNT COMPENSATING METHOD

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 562 days.

(21) Appl. No.: 12/395,201

(22) Filed: Feb. 27, 2009

(65) Prior Publication Data

US 2009/0219371 A1 Sep. 3, 2009

(30) Foreign Application Priority Data

Feb. 29, 2008 (JP) ..... 2008-051408

(51) Int. Cl.
*B65H 7/02* (2006.01)

(52) U.S. Cl. ..... 271/265.01; 271/265.02; 271/266; 271/268

(58) Field of Classification Search ..... 271/264, 271/265.01, 265.02, 266, 268, 277
See application file for complete search history.

(56) References Cited

U.S. PATENT DOCUMENTS

| | | | | |
|---|---|---|---|---|
| 5,602,571 | A * | 2/1997 | Suda et al. | 346/134 |
| 5,692,741 | A * | 12/1997 | Nakamura et al. | 271/10.03 |
| 6,761,351 | B1 * | 7/2004 | Howe | 271/3.15 |
| 6,769,759 | B2 | 8/2004 | Yamasaki et al. | |
| 7,036,811 | B2 * | 5/2006 | Howe | 271/3.13 |
| 7,343,119 | B2 * | 3/2008 | Matsuda et al. | 399/167 |
| 7,410,167 | B2 * | 8/2008 | Koga et al. | 271/266 |
| 7,628,400 | B2 * | 12/2009 | Ishikawa | 271/270 |
| 7,811,015 | B2 * | 10/2010 | Yanagi et al. | 400/76 |
| 7,837,194 | B2 * | 11/2010 | Terada | 271/266 |
| 7,900,907 | B2 * | 3/2011 | Furihata et al. | 271/4.1 |
| 7,954,813 | B2 * | 6/2011 | Matsumoto | 271/270 |
| 2004/0150154 | A1 * | 8/2004 | Howe | 271/228 |
| 2005/0163553 | A1 * | 7/2005 | Cercos et al. | 400/636 |
| 2006/0012104 | A1 * | 1/2006 | Kim | 271/10.01 |
| 2006/0088338 | A1 * | 4/2006 | Matsuda et al. | 399/167 |
| 2006/0221165 | A1 | 10/2006 | Kato | |
| 2007/0003352 | A1 * | 1/2007 | Koga et al. | 400/582 |
| 2007/0031175 | A1 | 2/2007 | Takeda et al. | |
| 2008/0008513 | A1 * | 1/2008 | Kakishima et al. | 400/579 |
| 2008/0050165 | A1 * | 2/2008 | Saito et al. | 400/582 |

(Continued)

FOREIGN PATENT DOCUMENTS

| | | | |
|---|---|---|---|
| JP | H08-090858 | A | 4/1996 |
| JP | H11-198460 | A | 7/1999 |
| JP | 2001-001584 | A | 1/2001 |
| JP | 2003-011344 | A | 1/2003 |

(Continued)

*Primary Examiner* — Michael McCullough
*Assistant Examiner* — Howard Sanders
(74) *Attorney, Agent, or Firm* — Baker Botts L.L.P.

(57) ABSTRACT

A sheet feeding device intermittently feeds a sheet according to commanded feeding amounts included in successively generated feeding commands. The sheet feeding device includes upstream and downstream feeding rollers rotated by respective first and second amounts of rotation corresponding to the commanded feeding amount. The sheet feeding device includes an obtaining portion for obtaining an overrun amount of the sheet immediately after a trailing edge of the sheet member has left the upstream feeding roller, based on a difference obtained by subtracting a product of a first radius and the first amount of rotation of the upstream feeding roller, from a product of a second radius and the second amount of rotation of the downstream roller. The obtained overrun amount is subtracted from the next commanded feeding amount, when estimating that the trailing edge leaves the upstream feeding roller during feeding of the sheet according to the next feeding command.

14 Claims, 7 Drawing Sheets

U.S. PATENT DOCUMENTS

| | | | | |
|---|---|---|---|---|
| 2008/0079215 | A1* | 4/2008 | Ouchi | 271/81 |
| 2008/0232880 | A1* | 9/2008 | Noguchi et al. | 399/397 |
| 2009/0066018 | A1* | 3/2009 | Iesaki et al. | 271/272 |
| 2010/0245516 | A1* | 9/2010 | Nakata | 347/104 |
| 2010/0327517 | A1* | 12/2010 | Krucinski | 271/227 |

FOREIGN PATENT DOCUMENTS

| | | | | |
|---|---|---|---|---|
| JP | 2004123313 | A | * | 4/2004 |
| JP | 2006-272772 | A | | 10/2006 |
| JP | 2007-063016 | A | | 3/2007 |
| JP | 2007-261262 | A | | 10/2007 |

* cited by examiner

SHEET FEEDING DEVICE, IMAGE RECORDING APPARATUS AND SHEET FEEDING AMOUNT COMPENSATING METHOD

CROSS REFERENCE TO RELATED APPLICATION

The present application claims the priority from Japanese Patent Application No. 2008-051408 filed Feb. 29, 2008, the disclosure of which is herein incorporated by reference in its entirety.

BACKGROUND OF THE INVENTION

1. Field of the Invention

The present invention relates to a sheet feeding device having a first feeding roller and a second feeding roller and configured to feed a sheet member on the basis of a commanded feeding amount included in each of successively generated feeding commands, an image recording apparatus including the sheet feeding device, and a method of compensating a feeding amount of the sheet member.

2. Description of Related Art

A known image recording apparatus is shown in FIGS. 7A-7C. This image recording apparatus has a carriage 201 on which a recording head 200 is mounted, and is provided with a sheet feeding device 210 for feeding a recording sheet S toward a platen 202. Similar known sheet feeding devices are shown in JP-8-90858A, JP-2006-272772A and JP-2007-63016A. The sheet feeding device 210 includes a feed roller pair 203 disposed on an upstream side of the platen 202 as viewed in a feeding direction of the recording sheet S, and a discharge roller pair 204 disposed on a downstream side of the platen 202 as viewed in the feeding direction.

As shown in FIGS. 7A-7C, the feed roller pair 203 consists of a drive roller 205 driven by a torque received from a drive motor, and a driven roller 206 biased by a coil spring 207 for pressing contact with the drive roller 205 and rotated with the drive roller 205. After the leading end of the recording sheet S has reached a pressure nip between the feed roller pair 203, a feeding movement of the recording sheet S is initiated with the leading end portion being nipped by and between the drive and driven rollers 205, 206. During this feeding movement, the recording sheet S is pressed with a biasing force of the coil spring 207.

After the recording sheet S is fed by the feed roller pair 203 by a predetermined distance, the leading end portion of the recording sheet S reaches a pressure nip between the discharge roller pair 204, and the recording sheet S is then fed by both the feed roller pair 203 and the discharge roller pair 204, as shown in FIG. 7B. Like the feed roller pair 203, the discharge roller pair 204 consists of a drive roller 208, and a driven roller 209 biased by a coil spring 211 for pressing contact with the drive roller 209. The discharge roller pair 204 contacts the recording sheet S after an image is recorded on the recording sheet S, so that the image may be deteriorated if the pressure of the pressure nip between the discharge roller pair 204 is excessively high. To prevent this deterioration of the image, a biasing force of the coil spring 211 for the driven roller 209 is selected to be smaller than that of the coil spring 207 for the driven roller 206.

When the recording sheet S is further fed by the feed roller pair 203 and discharge roller pair 204 by a predetermined distance, the trailing edge of the recording sheet S leaves the pressure nip between the feed roller pair 203, and the recording sheet S is fed by only the discharge roller pair 204, as shown in FIG. 7C.

It is desirable or ideal that an amount of feeding of the recording sheet S by the drive roller 205 and an amount of feeding of the recording sheet S by the drive roller 208 are made equal to each other. To this end, a power transmission coefficient of a power transmission mechanism from a drive power source such as a drive motor to the drive rollers 205, 208, and outside diameters of these drive rollers 205, 208 are determined such that the amounts of feeding by the two drive rollers 205, 208 per unit amount of operation (unit angle of rotation of a rotary member) of the drive power source are equal to each other. However, even if nominal peripheral speeds of the two drive rollers 205, 208 are designed to be equal to each other, dimensional errors of the drive rollers 205, 208 and the related components of the power transmission mechanism will cause a difference between the actual peripheral speeds of the drive rollers 205, 208. Namely, the actual peripheral speeds of the drive rollers 205, 208 are not usually equal to each other. In some sheet feeding devices, the peripheral speeds of the two drive rollers 205, 208 are intentionally made different from each other, for the purpose of preventing a flexure of the recording sheet S while the recording sheet S is fed by both of the two drive rollers 205, 208. Where the peripheral speed of the drive roller 208 is higher than that of the drive roller 205 in the known sheet feeding device 210, a tensile force T acts on the recording sheet S in the feeding direction (in the horizontal direction as seen in FIG. 7), while the recording sheet S is fed by both the feed roller pair 203 and the discharge roller pair 204, as indicated in FIG. 7B. This tensile force T has the largest value corresponding to a force of friction between the feed roller and discharge roller pairs 203, 204 and the recording sheet S. The friction force between the roller pairs 203, 204 and the recording sheet S is generated by a force of pressing contact of the roller pairs 203, 204 with the recording sheet S, and is almost proportional to this force of pressing contact. The tensile force T acting on the recording sheet S causes deformation of surface portions and shaft portions of the drive roller 208 and driven roller 209 of the discharge roller pair 204, and deformation of the power transmission mechanism from the drive motor or other drive power source to the drive roller 208. The tensile force T becomes absent or is zeroed when the force of pressing contact of the feed roller pair 203 with the recording sheet S is zeroed immediately after the trailing edge of the recording sheet has left the feed roller pair 203. When the tensile force T is zeroed, the deformed shaft portions of the discharge roller pair 204 and the deformed power transmission mechanism are restored to their original non-deformed states, with displacements of the shaft portions of the discharge roller pair 204 and a rise of the rotating speed of the drive roller 208, causing an excessive feeding movement of the recording sheet S by a distance larger than a distance corresponding to the commanded feeding amount. This excessive feeding movement will be simply hereinafter referred to as "an overrun" of the recording sheet S. As a result, the recording sheet S suffers from a so-called "hunting phenomenon" (or "image forming failure"), which considerably deteriorates the quality of the image formed by the image forming apparatus provided with the sheet feeding device.

SUMMARY OF THE INVENTION

The present invention was made in view of the background art described above. It is therefore an object of the present invention to provide a sheet feeding device, an image forming apparatus, and a sheet feeding amount compensating method, which make it possible to prevent an overrun of a sheet member due to a difference between a first feeding amount of the sheet member by a first feed roller and a second feeding amount of the sheet member by a second feed roller, for thereby improving the quality of an image formed on the sheet member, or the accuracy of an image forming operation performed on the sheet member.

The object indicated above can be achieved according to a first aspect of this invention, which provides a sheet feeding device for intermittently feeding a sheet member on the basis of a commanded feeding amount included in each of successively generated feeding commands, the sheet feeding device comprising a first feeding roller, a second feeding roller, an obtaining portion, an estimating portion and a subtracting portion. The first feeding roller is rotated by a first amount of rotation corresponding to the commanded feeding amount. The second feeding roller is disposed downstream of the first feeding roller as viewed in a feeding direction of the sheet member, and is rotated by a second amount of rotation corresponding to the commanded feeding amount. The obtaining portion is configured to obtain an overrun amount of the sheet member immediately after a trailing edge of the sheet member has left the first feeding roller, on the basis of a difference obtained by subtracting a first feeding amount which is a product of a first radius and the first amount of rotation of the first feeding roller, from a second feeding amount which is a product of a second radius and the second amount of rotation of the second feeding roller. The estimating portion is configured to estimate whether the trailing edge of the sheet member leaves the first feeding roller during feeding of the sheet member according to a next one of the successively generated feeding command. The subtracting portion is configured to subtract the overrun amount of the sheet member obtained by the obtaining portion, from the next commanded feeding amount included in the next feeding command, when the estimating portion estimates that the trailing edge of the sheet member leaves the first feeding roller.

The sheet feeding device constructed according to the present invention is used on an image recording apparatus of an ink-jet type capable of performing an image recording operation by ejecting ink droplets, for example. The sheet member is fed according to the feeding commands successively generated from a control portion of the sheet feeding device. Each of the feeding commands includes information relating to the feeding amount (commanded feeding amount) of the sheet member, and the first and second feeding rollers are rotated by respective predetermined amounts (first and second amounts of rotation, on the basis of the commanded feeding amount included in each feeding command.

The first and second rollers have respective dimensional errors within respective ranges of tolerance. In manufacturing a certain number of sheet feeding devices of the present invention, a corresponding number of the first and second feeding rollers are fabricated. In a strict sense, the fabricated feeding rollers have different outside diameters, and have different perimeters. Therefore, even if the first and second feeding rollers have the same nominal peripheral speed, the first and second feeding rollers have different actual peripheral speeds. Where the peripheral speed of the second feeding roller is higher than that of the first feeding roller, for instance, a tensile force acts on the sheet member in the feeding direction when the sheet member is fed by both of the first and second feeding rollers. This tensile force causes deformation of the roller surface of the second feeding roller and a transmission mechanism between a drive power source to the second feeding roller, during feeding of the sheet member by both of the first and second feeding rollers. The deformed second feeding roller and transmission mechanism are restored to their original non-deformed state immediately after the trailing edge of the sheet member has left the first feeding roller. However, the sheet member suffers from an overrun (is fed by a distance larger than a distance corresponding to the commanded feeding amount) when the deformed second feeding roller and transmission mechanism are restored to their original non-deformed states. It is noted that the overrun of the second feeding roller due to the tensile force takes place also where the second feeding amount is made larger than the first feeding amount for the purpose of preventing deflection of the sheet member when the sheet member is fed by both of the first and second feeding rollers.

The amount of feeding of the sheet member by the first feeding roller (first feeding amount) is equal to a product of the first radius of the first feeding roller and the first amount of rotation of the first feeding roller, while the amount of feeding of the sheet member by the second feeding roller (second feeding amount) is equal to a product of the second radius of the second feeding roller and the second amount of rotation of the second feeding roller. These first and second feeding amounts are respectively specific to the first and second feeding rollers. In the present sheet feeding device, the overrun amount of the sheet member is obtained by the obtaining portion on the basis of the difference obtained by subtracting the first feeding amount from the second feeding amount, and the estimating portion estimates whether the trailing edge of the sheet member leaves the first feeding roller during feeding of the sheet member according to the next feeding command. When the estimating portion estimates that the trailing edge of the sheet member leaves the first feeding roller, the obtained overrun amount is subtracted from the next commanded feeding amount, so that the sheet is fed by an amount equal to the next commanded feeding amount minus the overrun amount.

In the present sheet feeding device constructed as described above, the first and second feeding rollers are controlled to feed the sheet member by the amount equal to the next commanded feeding amount minus the overrun amount when the trailing edge of the sheet member is expected to leave the first feeding roller. The sheet member would be otherwise overrun by the overrun amount if the first and second feeding rollers were controlled to feed the sheet member by the next commanded feeding amount when the trailing edge of the sheet member leaves the first feeding roller. Accordingly, the recording sheet is actually fed by the commanded feeding amount and will not be actually overrun when the trailing edge leaves the feeding roller pair 89, making it possible to effectively prevent the conventionally experienced hunting phenomenon due to the overrun of the sheet member at the end of an image recording operation of an image recording apparatus of an ink-jet type with intermittent feeding actions of the sheet member by the sheet feeding device.

The object indicated above can also be achieved according to a second aspect of this invention, which provides an image recording apparatus comprising the sheet feeding device according to the first aspect of the present invention described above and an image recording unit, and configured to perform an image recording operation on the sheet member fed by the sheet feeding device, wherein the first and second feeding rollers are disposed on respective upstream and downstream sides of the image recording unit.

The image recording apparatus according to the second aspect of this invention has substantially the same advantage as described above with respect to the sheet feeding device according to the first aspect of the invention described above.

The object indicated above can also be achieved according to a third aspect of the invention, which provides a method of compensating an amount of feeding of a sheet member which is intermittently fed on the basis of a commanded feeding amount included in each of successively generated feeding commands, by a first feeding roller rotated by a first amount of rotation corresponding to the commanded feeding amount, and a second feeding roller disposed downstream of the first feeding roller as viewed in a feeding direction of the sheet member and rotated by a second amount of rotation corresponding to the commanded feeding amount, the method comprising a first step, a second step and a third step. In the first step, an overrun amount of the sheet member immediately after a trailing edge of the sheet member has left the first feeding roller is obtained on the basis of a difference obtained by subtracting a first feeding amount which is a product of a first radius and the first amount of rotation of the first feeding roller, from a second feeding amount which is a product of a second radius and the second amount of rotation of the second feeding roller. The second step is implemented to estimate whether the trailing edge of the sheet member leaves the first feeding roller during feeding of the sheet member according to a next one of the successively generated feeding command. The third step is implemented to subtract the overrun amount of the sheet member obtained in the first step, from the next commanded feeding amount included in the next feeding command, when it is estimated in the second step that the trailing edge of the sheet member leaves the first feeding roller.

The feeding amount compensating method according to the third aspect of this invention is effective to prevent the overrun of the sheet member due to a difference between the first feeding amount of the first feeding roller and the second feeding amount of the second feeding roller, thereby making it possible to improve the quality of an image recorded on the sheet member.

BRIEF DESCRIPTION OF THE DRAWINGS

The above and other objects, features, advantages and technical and industrial significance of the present invention will be better understood by reading the following detailed description of a preferred embodiment of the present invention, when considered in connection with the accompanying drawings, in which.

DETAILED DESCRIPTION OF THE PREFERRED EMBODIMENT

<Description of Multi-Apparatus>

Figure 1:
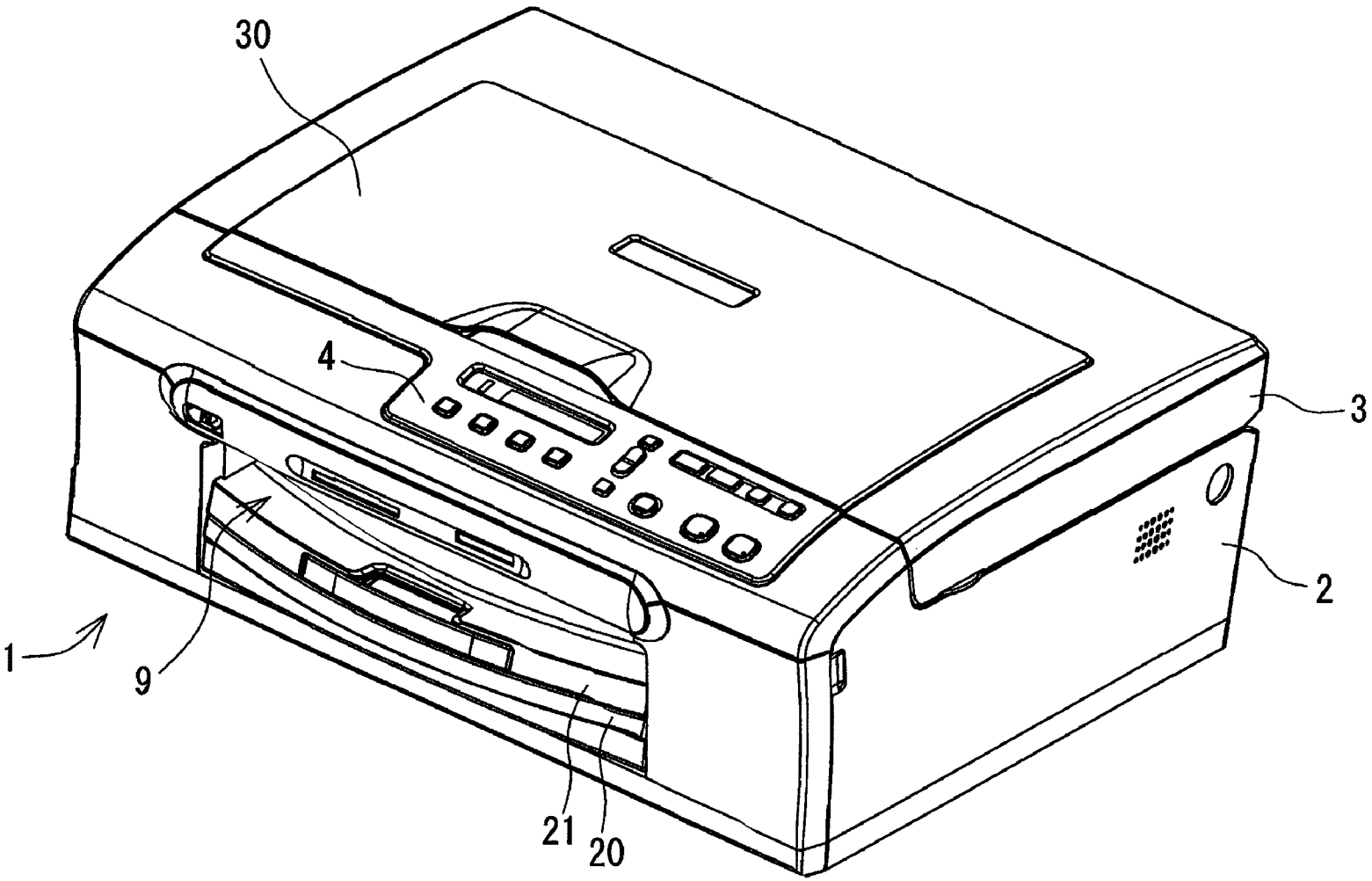
FIG. 1 is a perspective view showing an external appearance of a multi-function apparatus 1.

Referring first to FIG. 1, there is shown a multi-function apparatus 1 which is a multi-function product (MFP) incorporating a printer portion 2 and a scanner portion 3 and having a printing function, a scanning function, a copying function and a telecopier or facsimile transmission function. As shown in FIG. 1, the multi-function apparatus 1 takes the form of a generally rectangular parallelepiped, and is provided at its lower section with the printer portion 2, and at its upper portion with the scanner portion 3. The printer portion 2, which is of an ink-jet type, is an image recording apparatus constructed according to one preferred embodiment of the present invention.

The printer portion 2 is configured to form a desired image or record a desired document on a recording sheet (a sheet member to be fed by a sheet feeding device according to the illustrated embodiment of this invention), according to appropriate printing data. The printer portion 2 has a front section formed with an opening 9 in which there are accommodated a sheet supply tray 20 and a sheet discharge tray 21 such that the sheet discharge tray 21 is located above the sheet supply tray 20. A stack of recording sheets is accommodated in the sheet supply tray 20, and the recording sheets are supplied one after another from the stack, for performing image forming operations on the recording sheets by the printer portion 2. The recording sheets on which the image forming operations have been performed are received by the sheet discharge tray 21.

The scanner portion 3 is a so-called "flatbed scanner (FBS)". The scanner portion 3 is provided at its top section with a cover 30 which is a top covering plate of the multi-function apparatus 1 and which is pivotally movable between its open position for placing an original to be read by the scanner portion 3, and its closed position for holding the original. The original is placed on a contact glass plate disposed under the cover 30 placed in the closed position. A plurality of contact image sensors (CIS) are disposed on a carriage (not shown) provided under the cover 30, such that the contact image sensors are arranged in one row extending in a direction of width of the multi-function apparatus 1. The carriage is reciprocable along the back surface of the contact glass plate, in a direction perpendicular to the direction of extension of the above-indicated row of the contact image sensors. During the reciprocating movement of the carriage in the above-indicated direction, an image of the original placed on the contact glass plate is read by the contact image sensors. Since the scanner portion 3 does not directly relate to the present invention, no further or detailed description is deemed necessary for understanding the present invention.

As shown in FIG. 1, the multi-function apparatus 1 is further provided at its front upper section with an operator's control panel 4 used for operating the printer portion 2 and the scanner portion 3. The operator's control panel 4 has various control pushbuttons and a liquid crystal display. The multi-function apparatus 1 is operated according to control commands (control signals) input through the operator's control panel 4. Where the multi-function apparatus 1 is connected to an external computer, the multi-function apparatus 1 is operated according to control commands or signals received from the external computer through a printer driver and a scanner driver, as well as the control commands or signals input through the operator's control panel 4.

<Detailed Description of Printer Portion 2>

The printer portion 2 is configured to record an image on the recording sheet according to the ink-jet printing method. The printer portion 2 constructed according to the present embodiment of the invention is operable to perform a full-color image recording operation or a monochrome image recording operation, using four colors of ink, namely, a cyan (C) ink, a magenta (M) ink, a yellow (Y) ink and a black (Bk) ink.

Figure 2:
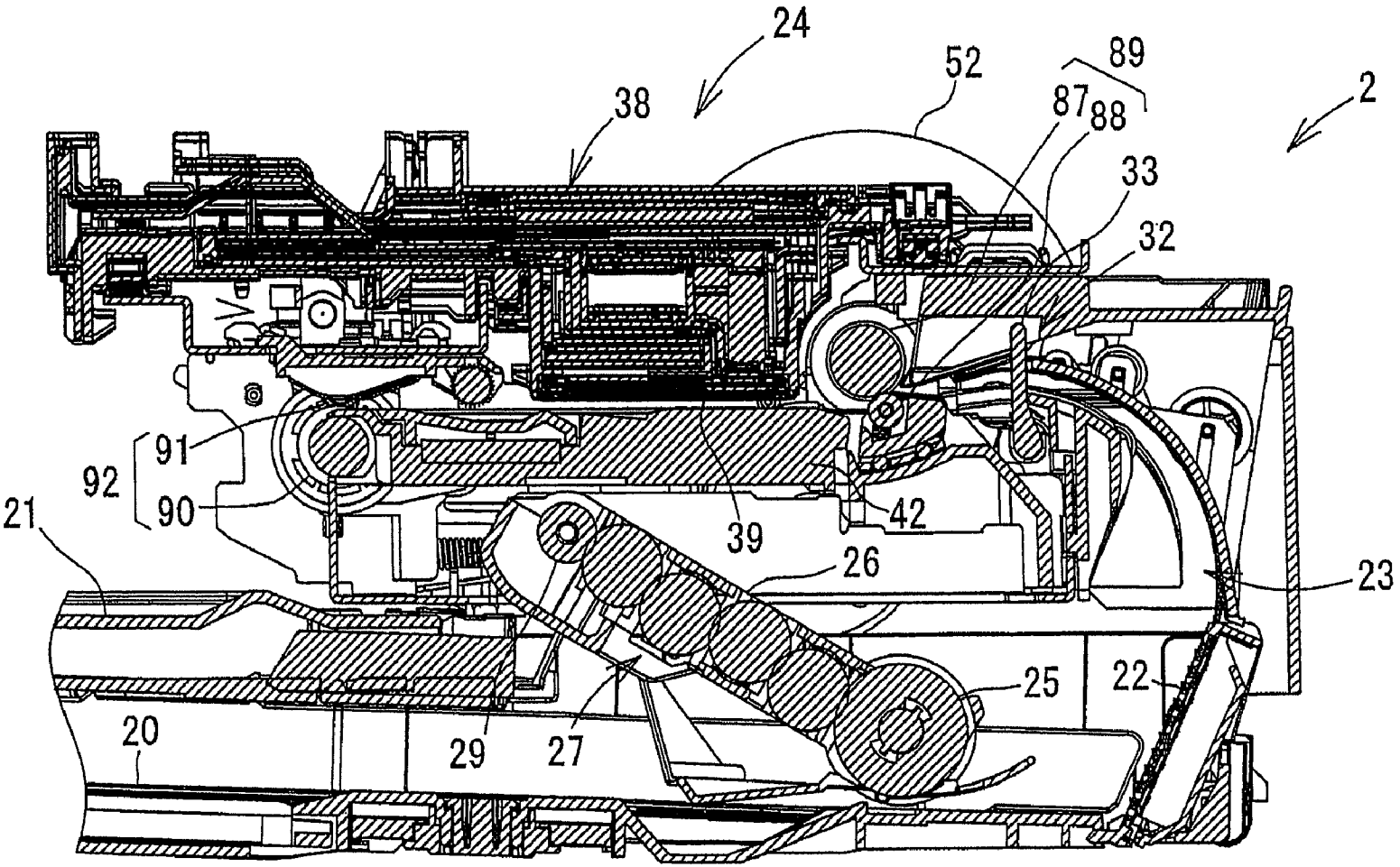
FIG. 2 is an enlarged elevational view in cross section showing major components of a printer portion 2 of the multi-function apparatus of FIG. 1.

As shown in FIG. 2, the printer portion 2 is provided at its bottom section with the sheet supply tray 20, and a sheet supply roller 25 is disposed above the sheet supply tray 20. A drive shaft 29 is supported by a frame (not shown) of the printer portion 2, and a support arm 26 for supporting the sheet supply roller 25 is pivotally supported by the drive shaft 29. The sheet supply roller 25 is rotatably supported at a free or distal end portion of the support arm 26. The drive shaft 29 is operatively connected to a drive motor (LF motor) 95 (shown in FIG. 4) provided as a drive power source for driving the sheet supply roller 25. The support arm 26 is provided with a gear drive mechanism 27 arranged to transmit a rotary motion of the drive shaft 29 driven by the drive motor 95, to the sheet supply roller 25. Namely, a rotary drive force generated by the drive motor 95 is transmitted to the sheet supply roller 25 through the drive shaft 29 and the gear drive mechanism 27, so that the sheet supply roller 25 is rotated to supply the recording sheets.

When the sheet supply roller 25 is rotated while the sheet supply roller 25 is held in pressing contact with the top of the stack of recording sheets in the sheet supply tray 20, the uppermost recording sheet of the stack is fed out of the sheet supply tray 20 owing to a force of friction between the circumferential surface of the sheet supply roller 25 and the uppermost recording sheet, in the direction toward the back side of the multi-function apparatus 1 (in the right direction as seen in FIG. 2). A slant plate 22 is disposed adjacent to the inner end (right-hand side end as seen in FIG. 2) of the sheet supply tray 20, so that the recording sheet fed out of the sheet supply tray 20 comes into abutting contact with the slant plate 22, and is thus guided upwards, The slant plate 22 defines a part of a sheet feeding path 23. Described more specifically, the sheet feeding path 23 extends upwards from the slant plate 22, and is curved toward the front side of the multi-function apparatus 1, that is, in the left direction as seen in FIG. 2. The sheet feeding path 23 further extends horizontally from the back side toward the front side of the multi-function apparatus 1, under an image recording unit 24 and leads to the sheet discharge tray 21. Accordingly, the recording sheet accommodated in the sheet supply tray 20 is fed out of this tray 20, fed upwards and moved along a U-shaped portion of the sheet feeding path 23, advanced to the image recording unit 24, and received in the sheet discharge tray 21 after an image recording operation of the image recording unit 24 is performed on the recording sheet.

As also shown in FIG. 2, the image recording unit 24 is disposed so as to define a horizontally extending part of the sheet feeding path 23. The image recording unit 24 includes a recording head 39 of an ink-jet type, and a carriage 38 carrying the recording head 39. The carriage 38 is supported such that the carriage 38 is slidable in a direction perpendicular to the feeding direction of the recording sheet (horizontal direction as seen in FIG. 2), that is, slidable in the direction perpendicular to the plane of FIG. 2.

The recording head 39 is mounted on the bottom surface of the carriage 38, and has a multiplicity of nozzles (not shown in FIG. 2) exposed in the bottom surface of the carriage 38. The recording head 39 is supplied with the inks of the four colors from respective ink cartridges (not shown) disposed in the multi-function apparatus 1. A platen 42 is disposed in an opposed relation with the bottom surface of the carriage 38. When the carriage 38 is reciprocated, minute droplets of the inks are ejected from the selected ones of the nozzles so that the desired image is formed on the recording sheet which is fed on the platen 42.

A sheet sensor 32 for detecting the leading edge of the recording sheet is disposed adjacent to a downstream end of the U-shaped portion of the sheet feeding path 23. The sheet sensor 32 consists of a pivotable member 33, and a switch (not shown) which is turned ON and OFF depending upon whether the pivotable member 33 is placed in a first position (shown in FIG. 2) in which the pivotable member 33 intersects the sheet feeding path 23, or a second position in which the pivotable member 33 extends almost in parallel with the sheet feeding path 23. Namely, the pivotable member 33 is supported pivotally between the first and second positions, and is pivotable from the first position to the second position when the leading edge of the recording sheet being fed along the sheet feeding path 23 comes into abutting contact with the pivotable member 33 placed in the first position. In the second position, the pivotable member 33 is held in abutting contact with an appropriate contactor of the above-indicated switch, whereby the switch is turned ON. The switch of the sheet sensor 32 is connected to a control portion 100 (which will be described), so that the control portion 100 receives a signal indicating whether the switch is placed in the ON state or OFF state, that is, whether the leading edge of the recording sheet has reached the position of the sheet sensor 32.

As shown in FIG. 2, a feed roller pair 89 consisting of a feed roller 87 (functioning as a first feeding roller) and a pinch roller 88 (functioning as a first driven roller) is disposed on an upstream side of the image recording unit 24 and on a downstream side of the sheet sensor 32, as seen in the feeding direction of the recording sheet. The pinch roller 88 is rotatably supported at a position below the feed roller 87. In the present embodiment, the pinch roller 88 is biased by a suitable biasing means such as a coil spring or a sheet spring, for elastically pressing contact with the feed roller 87 with a predetermined biasing force. Accordingly, the circumferential surface of the pinch roller 88 is pressed against the circumferential surface of the feed roller 87. It is noted that the sheet feeding device according to the present embodiment of the invention includes the feed roller pair 89, a discharge roller pair 92 (described below), and the above-indicated control portion 100 (described below in detail).

The feed roller 87 has a shaft connected to a gear drive mechanism 85 (shown in FIG. 4) consisting of a plurality of gears. The above-described drive motor 95 provided in the printer portion 2 and used to rotate the sheet supply roller 25 as described above is also used to drive the feed roller 87 of the feed roller pair 89 and a discharge roller 90 of the discharger roller pair 92. The drive motor 95 is controlled by the control portion 100 (shown in FIG. 4), and is connected to one end portion of the gear drive mechanism 85 so that a rotary drive force of the drive motor 95 is transmitted to the feed roller 87 through the gear drive mechanism 85, whereby the feed roller 86 is rotated at a predetermined speed. The pinch roller 88 in pressing contact with the feed roller 87 is rotated at the same peripheral speed as the feed roller 87.

After the leading end portion of the recording sheet reaches the pressure nip between the feed roller 87 and the pinch roller 88, the pinch roller 88 is moved downwards by an amount corresponding to the thickness of the recording sheet, whereby the recording sheet is pinched by and between the feed roller 87 and the pinch roller 88. As a result, a torque of the feed roller 87 is transmitted to the recording sheet. Subsequently, the recording sheet is fed through the pressure nip between the feed roller 87 and the pinch roller 88, toward the platen 42. It is noted that the circumferential surface of the feed roller 87 is roughened by spraying a powdered ceramic material, to give the circumferential surface a friction coefficient high enough to assure firm nipping of the recording sheet between the feed roller 87 and the pinch roller 88, and stable transferring of the torque of the feed roller 87 to the recording sheet.

The above-indicated discharge roller pair 92 is disposed on a downstream side of the image recording unit 24. The discharge roller pair 92 consists of the above-indicated discharge roller 90 (functioning as a second feeding roller), and a spur 91 (functioning as a second driven roller). The recording sheet on which the recording operation has been performed is nipped and fed by the discharge roller pair 92. The spur 92 is rotatably supported at a position above the feed roller 90, so that the feed roller 90 contacts the back surface of the recording sheet while the spur 91 contacts the front surface of the recording sheet on which the image has been recorded. In the present embodiment, the spur 91 is biased by a suitable biasing means such as a coil spring or a sheet spring, for elastically pressing contact with the discharge roller 90 with a predetermined biasing force. However, the biasing force with which the spur 91 is pressed against the discharge roller 90 is made smaller than the biasing force with which the pinch roller 88 is pressed against the feed roller 87, for preventing deterioration of the image recorded on the front surface of the recording sheet. The circumferential surface of the discharge roller 90 is provided by a flexible material such as a rubber or sponge material, for ensuring stable nipping of the recording sheet between the discharge roller 90 and the spur 91, with a relatively small force of pressing contact.

The feed roller 87 and the discharge roller 90 are operatively connected to each other by a transmission mechanism 81 (shown in FIG. 4) which consists of a plurality of gears. Namely, the torque is transmitted from the feed roller 87 to the discharge roller 90 through the transmission mechanism 81. In other words, the drive force of the drive motor 92 is transmitted to the discharge roller 90 through the gear drive mechanism 85, feed roller 87 and transmission mechanism 81, so that the discharge roller 90 is rotated at a predetermined speed. In the present embodiment, the feed roller 87 and the discharge roller 90 are rotated by a common drive power source in the form of the drive motor (LF motor) 95.

The feed roller 87 has a shaft provided with an encoder disc 52 which has a peripheral portion patterned to provide light-shielding sections and light-transmitting section that are alternately arranged at a predetermined pitch. At a position opposed to the peripheral portion of the encoder disc 52, there is disposed a photoelectric sensor 54 (shown in FIG. 4) having a light-emitting element and a light-receiving element between which the peripheral portion of the encoder disc 52 is interposed. The encoder disc 52 and the photoelectric sensor 54 cooperate to constitute a rotary encoder configured to detect an angular position (rotary position) of the feed roller 87. When the encoder disc 52 is rotated with the feed roller 87, the photoelectric sensor 54 generates a pulse signal (rectangular pulse signal) corresponding to the above-described pattern of the encoder disc 52. The generated pulse signal is applied to the control portion 100 (shown in FIG. 4). The control portion 100 counts the number of pulses of the pulse signal, and calculates the number of rotations (angle of rotation) and rotating speed of the feed roller 87 on the basis of the counted number of the pulses and the width of the pulses.

After the leading end portion of the recording sheet has reached the platen 42, the recording sheet is intermittently fed by the feed roller pair 89, by a predetermined incremental distance for each of the intermittent feeding movements. The recording head 39 is repeatedly moved to record the image on the recording sheet while the recording sheet is intermittently fed. Described more precisely, the recording head 39 is moved to record a line of image while the recording sheet is temporarily held at rest. After the movement of the recording head 39 to record the line of image, the recording sheet is fed by the predetermined incremental distance. The movement of the recording head 39 and the feeding of the recording sheet are repeated to record lines of image forming the desired image. The intermittent feeding movements of the recording sheet are implemented according to drive signals which are fed from a CPU 101 of the control portion 100 to a motor drive 110 (which will be described) for driving the drive motor 95.

As the recording sheet is fed by the feed roller pair 89, the leading edge of the recording sheet reaches the pressure nip between the discharge roller 90 and spur 91 of the discharge roller pair 92. Thereafter, the recording sheet is fed by both the feed roller pair 89 and the discharge roller pair 92, with the leading end portion of the recording sheet being nipped between the discharge roller pair 92, while the trailing end portion being nipped between the feed roller pair 89.

When the recording sheet is further fed, the trailing edge of the recording sheet leaves the pressure nip between the feed roller 87 and the pinch roller 88, and the recording sheet is subsequently fed intermittently by only the discharge roller pair 92, with intermittent feeding movements corresponding to the respective lines of image to be recorded on the recording sheet. After the entirety of the desired image has been recorded on the recording sheet, the discharge roller 90 is continuously rotated to eject the recording sheet into the sheet discharge tray 21.

In the present embodiment, the transmission mechanism 81 has a speed ratio which is a reciprocal of a ratio of an outside diameter of the discharger roller 90 to an outside diameter of the feed roller 87. Accordingly, where the outside diameters of the feed and discharger rollers 87, 90 have the same nominal value, the two rollers 87, 90 have the same peripheral speed. However, it is not actually possible to fabricate the two rollers 87, 90 having completely the same nominal outside diameter, even if the two rollers 87, 90 are machined with a high degree of dimensional accuracy.

If the outside diameter of the discharge roller 90 is larger than that of the feed roller 87, the amount of intermittent feeding of the recording sheet by the discharge roller 90 per unit amount of operation of the drive motor 95 is larger than that of the recording sheet by the feed roller 87. In this case the amount of intermittent feeding of the recording sheet when the recording sheet is intermittently fed by only the feed roller pair 89 is different from that when the recording sheet is intermittently fed by only the discharge roller pair 92, where the amount of operation of the drive motor 95 is the same in these two cases. In the present embodiment wherein the common drive motor 95 is used to drive the feed roller 87 and the discharge roller 90, the amount of intermittent feeding of the recording sheet varies during the entire image recording operation, resulting in considerable deterioration of the quality of the image recorded on the recording sheet, if the control portion 100 generates the same feeding command commanding the drive motor 95 to be operated by the same amount when the recording sheet is intermittently fed by only the feed roller pair 89 and when it is intermittently fed by only the discharge roller pair 92. For overcoming this drawback, it is a conventional practice to compensate the amount of feeding by the feed roller pair 89 and the amount of feeding by the discharge roller pair 92 on the basis of a first compensating parameter P and a second compensating parameter Q (which will be described), for maintaining the amount of intermittent feeding of the recording sheet constant during the entire image recording operation.

When the recording sheet is intermittently fed by only the feed roller pair 89, for example, the amount of operation of the drive motor 95 is controlled by the control portion 100 according to the first compensating parameter P so that the amount of intermittent feeding of the recording sheet by the feed roller pair 89 is suitably compensated. Described in detail, the number of the pulses of the photoelectric sensor 54 which represents the angle or amount of rotation of the feed roller 87 (corresponding to a first amount of rotation) corresponding to a commanded feeding amount included in the above-indicated feeding command (control signal relating to the amount of feeding) is compensated according to the first compensating parameter P, so that the drive motor 95 is kept operated until the thus compensated number of the pulses has been counted. As a result, the feed roller 87 is rotated by the amount compensated according to the first compensating parameter P to feed the recording sheet when the feeding command is generated by the control portion 100. When the recording sheet is intermittently fed by only the discharge roller pair 92, the amount of operation of the drive motor 95 is controlled by the control portion 100 according to the second compensating parameter Q so that the amount of intermittent feeding of the recording sheet by the discharge roller pair 92 is suitably compensated. Described in detail, the number of the pulses of the photoelectric sensor 54 which represents the angle of rotation of the discharge roller 90 (corresponding to a second amount of rotation) corresponding to the commanded feeding amount included in the above-indicated feeding command is compensated according to the second compensating parameter Q, so that the drive motor 95 is kept operated until the thus compensated number of the pulses has been counted. As a result, the discharge roller 92 is rotated by the amount compensated according to the second compensating parameter Q to feed the recording sheet when the feeding command is generated by the control portion 100.

In the present embodiment, the drive motor 95 is controlled such that the amount of rotation of the feed roller 87 is compensated according to the first compensating parameter P, when the recording sheet is intermittently fed by only the feed roller pair 89, and when the recording sheet is intermittently fed by both the feed roller pair 89 and the discharger roller pair 92. When the recording sheet is intermittently fed by only the discharge roller pair 92, the drive motor 95 is controlled such that the amount of rotation of the discharge roller 90 is compensated according to the second compensating parameter Q.

For instance, the first and second compensating parameters P, Q are obtained on the basis of a plurality of test patterns (reference line 60 and first through seventh lines 61-67 which will be described) which are recorded on the recording sheet during a test recording operation. For example, it is presumed that the recording sheet is fed by a distance of one inch when 7200 pulses of the photoelectric sensor 54 are counted by the control portion 100, where the feed roller 87 and the discharge roller 90 have the nominal dimensions. Initially, the recording sheet is advanced to a position from which the recording sheet is fed by only the feed roller pair 89, as indicated in FIG. 3A. Then, a reference line 60 (indicated by broken line in FIG. 3) is recorded by the first nozzle 57 of the recording head 39 on the recording sheet in the direction of its width perpendicular to the feeding direction. Where the multiplicity of nozzles of the recording head 39 has a spacing pitch ΔD of 1/150 inch. After the reference line is recorded, the recording sheet is fed by a distance of 70/150 inch (corresponding to 3360 pulses of the photoelectric sensor 54) by only the feed roller pair 89, and a line is recorded by the seventy first nozzle 58 which is spaced from the first nozzle 57 by the distance of 70/150 inch in the downstream direction. If the feed roller 87 has the nominal dimensions, the line recorded by the seventy first nozzle 58 shall completely overlaps or coincides with the reference line 60 previously recorded on the recording sheet. If the actual outside diameter of the feed roller 87 deviates from the nominal value, the two lines are more or less spaced apart from each other.

Figure 3B:
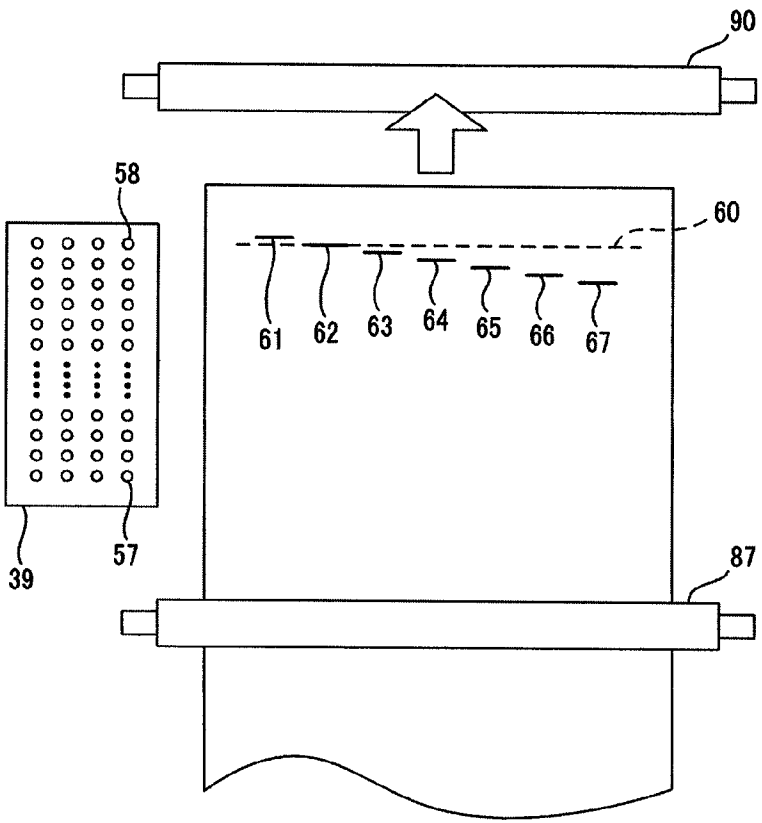
FIGS. 3A and 3B are views for explaining methods of obtaining a first compensating parameter P and a second compensating parameter Q used by a control portion 100 of the multi-function apparatus of FIG. 1, to control a sheet feeding device.
Figure 3A:
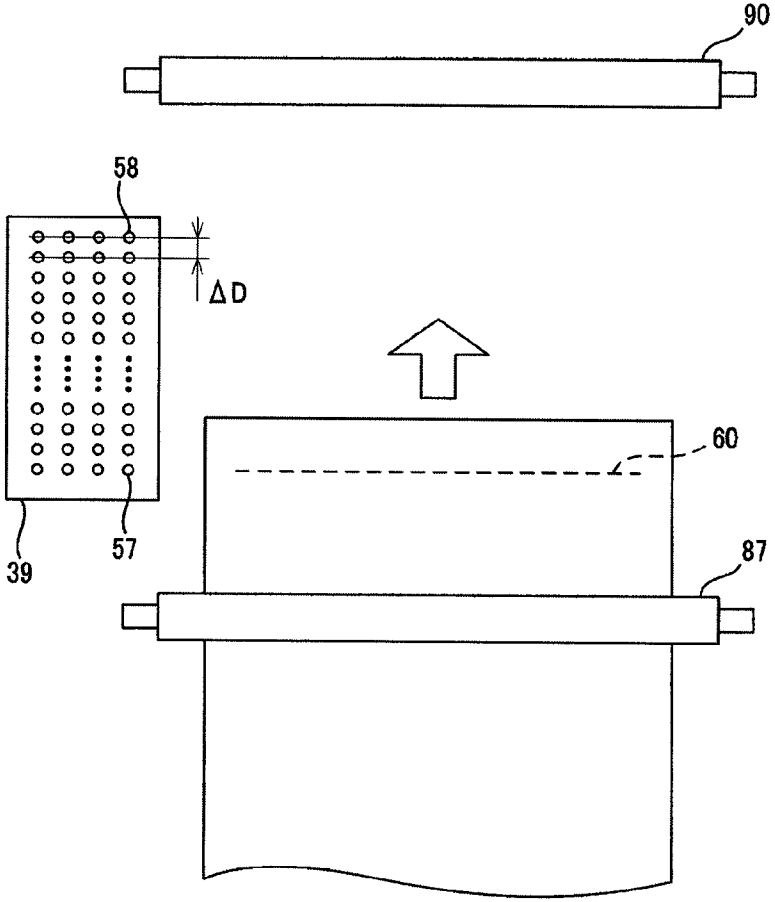

In view of the above-described fact, the recording sheet on which the reference line 60 has been recorded by the first nozzle 57 is fed until 3330 pulses of the photoelectric sensor 54 are counted by the control portion 100, and a first line 61 is recorded at this position by the appropriate nozzle, as indicated in FIG. 3B. Then, second through seventh lines 62^67 are recorded at the respective positions on the recording sheet, which are spaced from the reference line 60 by respective distances which respectively correspond to 3340, 3350, 3360, 3370, 3380 and 3390 pulses of the photoelectric sensor 54. It is noted that the first through seventh lines 61-67 have a length considerably shorter than the length of the reference line 60, and are spaced from each other in the direction of width of the recording sheet, as indicated in FIG. 3B. If the feed roller 87 has the nominal dimensions, the reference line 60 and the fourth line 64 shall overlap or coincide with each other. If the second line 62 coincides with the reference line 60, the actual outside diameter of the feed roller 87 is larger by 0.6% than the nominal value, that is, 1.006 (approx. 3360/3340) times the nominal value. In the present embodiment, a ratio (1.006) or percent value (100.6%) of the actual outside diameter of the feed roller 87 to the nominal value is set as the first compensating parameter P used to compensate the amount of intermittent feeding by the feed roller 87.

If the incremental distance of intermittent feeding of the recording sheet during the image recording operation is equal to 1/24 inch corresponding to 300 pulses of the photoelectric sensor 54, the recording sheet is fed by the feed roller 87 by a distance larger than 1/24 inch when the actual outside diameter of the feed roller 87 is larger by 0.6% than the nominal value (when the actual outside diameter is 100.6% of the nominal value). When this feed roller 87 is used, the counted number of pulses of the photoelectric sensor 54 at which the feeding of the recording sheet is to be stopped should not be 300, but should be reduced to 298.2 (=300×(1/1.006), which is a product of 300 and 1/P (reciprocal of the first compensating parameter P). Thus, the first compensating parameter P (100.6%) is used to compensate the number of pulses of the photoelectric sensor 54 which represents or determines the amount of intermittent feeding of the recording sheet by the feed roller 87. A range within which the first compensating parameter P falls changes depending upon the actual outside diameter of the feed roller 87. In other words, the first compensating parameter P is determined according to the actual outside diameter of the feed roller 87. The first compensating parameter P thus determined is specific to the multi-function apparatus 1, that is, specific to the feed roller 87, and is stored in an EEPROM 104 (described below) of the control apparatus 100.

To obtain the second compensating parameter Q, the recording sheet is initially advanced to a position from which the recording sheet is fed by only the discharge roller 92. Then, the reference line 60 is recorded by the first nozzle 57 of the recording head 39 on the recording sheet in the direction of its width perpendicular to the feeding direction. The ratio or percent value of the actual outside diameter of the discharger roller 90 to the nominal value is obtained as the second compensating parameter for the discharge roller 90, in the same manner as described above with respect to the first compensating parameter P. A range within which the second compensating parameter Q falls changes depending upon the actual outside diameter of the discharge roller 90. In other words, the second compensating parameter Q is determined according to the actual outside diameter of the discharge roller 90. This second compensating parameter Q is specific to the multi-function apparatus 1, that is, specific to the discharge roller 90, and is stored in the EEPROM 104 of the control apparatus 100.

The method of obtaining the first compensating parameter P and the second compensating parameter Q is not limited to that described above. For instance, the compensating parameters P, Q may be obtained according to methods as described in JP-2007-261262A, JP-2003-11344A and JP-2001-1584A.

Even when the drive motor 95 is controlled according to the first and second compensating parameters P, Q to drive the feed roller 87 and the discharge roller 92 for intermittently feeding the recording sheet by the predetermined incremental distance, there exits an inevitable difference between the peripheral speeds of these two rollers 87, 92 when the recording sheet is intermittently fed by both the feed roller 87 and the discharge roller 90, which are rotated by the common drive motor 95. Where the peripheral speed of the discharge roller 90 is higher than that of the feed roller 87, a tensile force acts on the recording sheet while the recording sheet is fed by the two rollers 87, 90. This tensile force causes deformation of the shaft of the discharge roller 90 and some components of the transmission mechanism 80. The deformed components are restored to their original non-deformed states when the trailing edge of the recording sheet has left the pressure nip between the feed roller 87 and the pinch roller 88, whereby the recording sheet suffers from an undesirable overrun, which may take place during an image recording operation, causing a hunting phenomenon (image forming failure).

Figure 6:
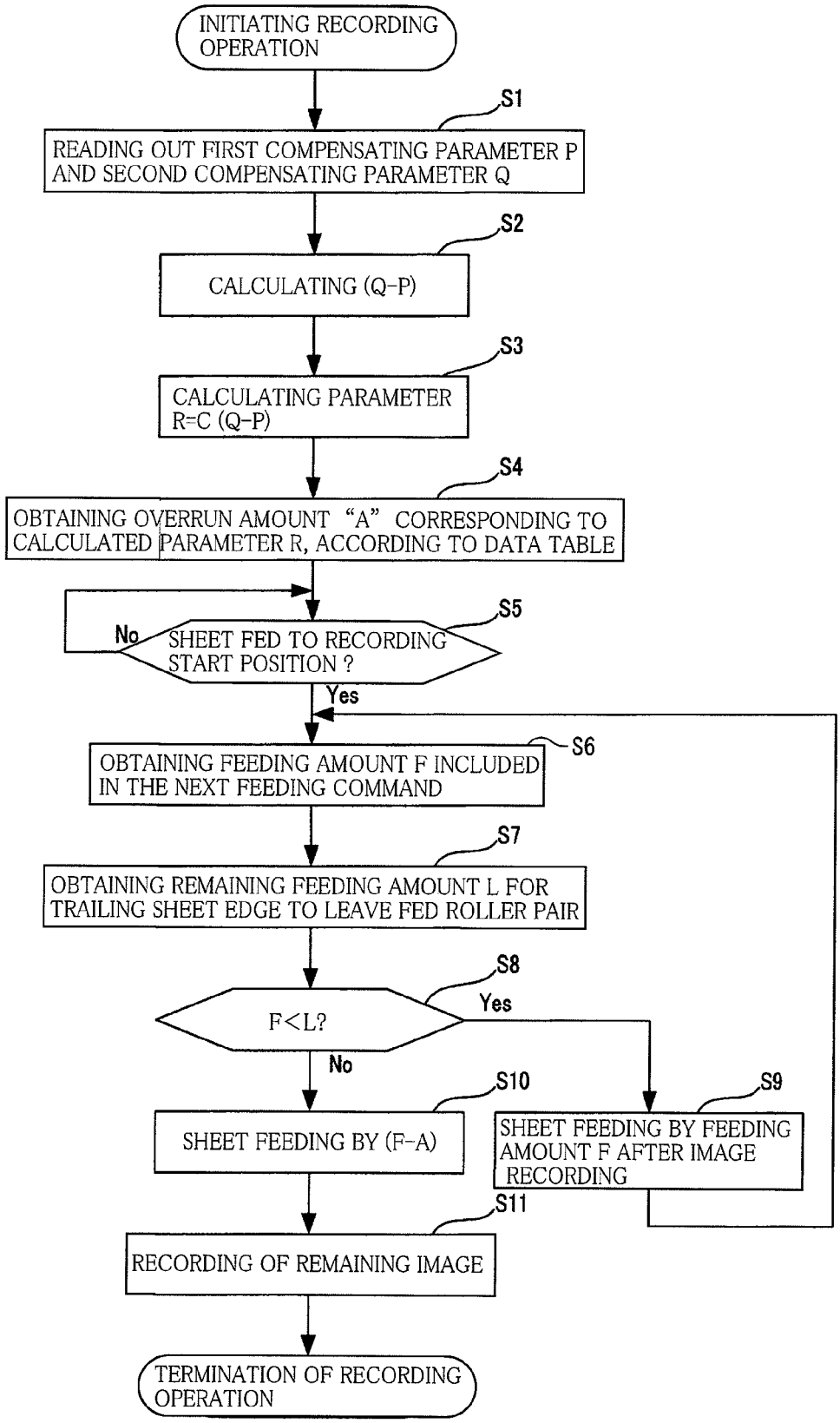
FIG. 6 is a flow chart illustrating a control routine executed by the control portion 100 to adjust a commanded amount of feeding of the recording sheet by a feed roller 87 and a discharger roller 90, and a method of compensating the feeding amount of the recording sheet.
Figure 7A:
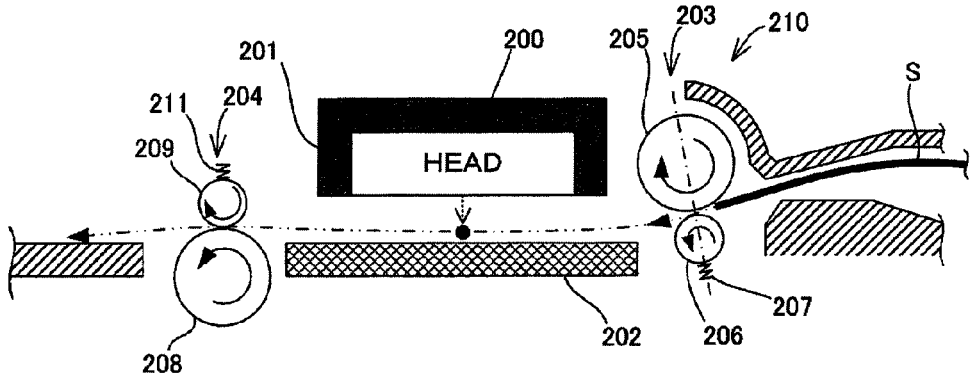
FIG.7A PRIOR ART
FIGS. 7A, 7B and 7C are views showing an arrangement of a known sheet feeding device 210.
Figure 7B:
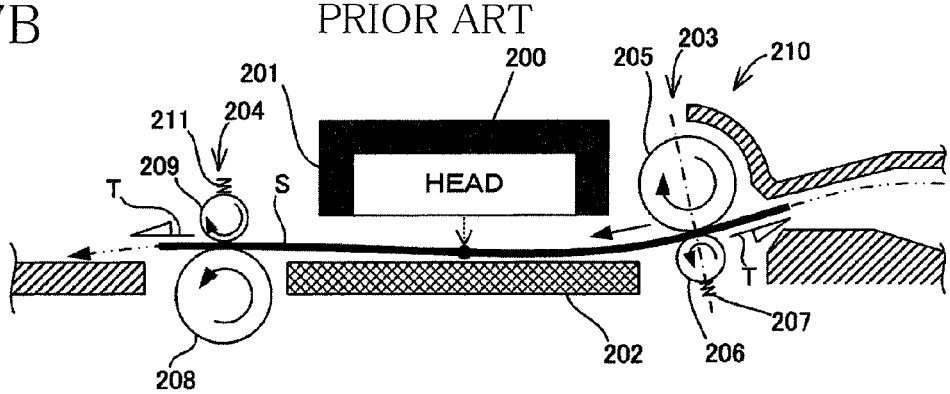
FIG.7B PRIOR ART
Figure 7C:
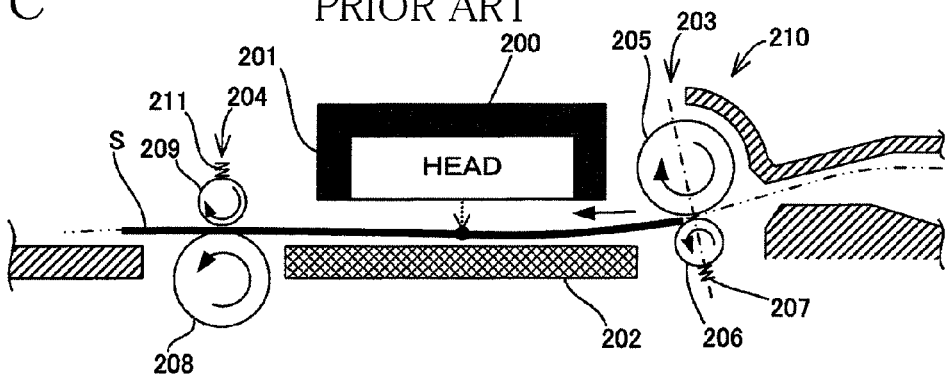
FIG.7C PRIOR ART

In the present embodiment, however, the drive motor 95 is controlled by the control portion 100 according to a control routine illustrated in the flow chart of FIG. 6, so as to adjust the amount of intermittent feeding of the recording sheet by the feed roller 87, for thereby preventing the overrun of the recording sheet when the trailing edge of the recording sheet leaves the pressure nip of the feed roller pair 89. Thus, the sheet feeding device according to the present embodiment is free from the deterioration of the recorded image due to the overrun of the recording sheet.

<Description of Control Portion 100>

Figure 4:
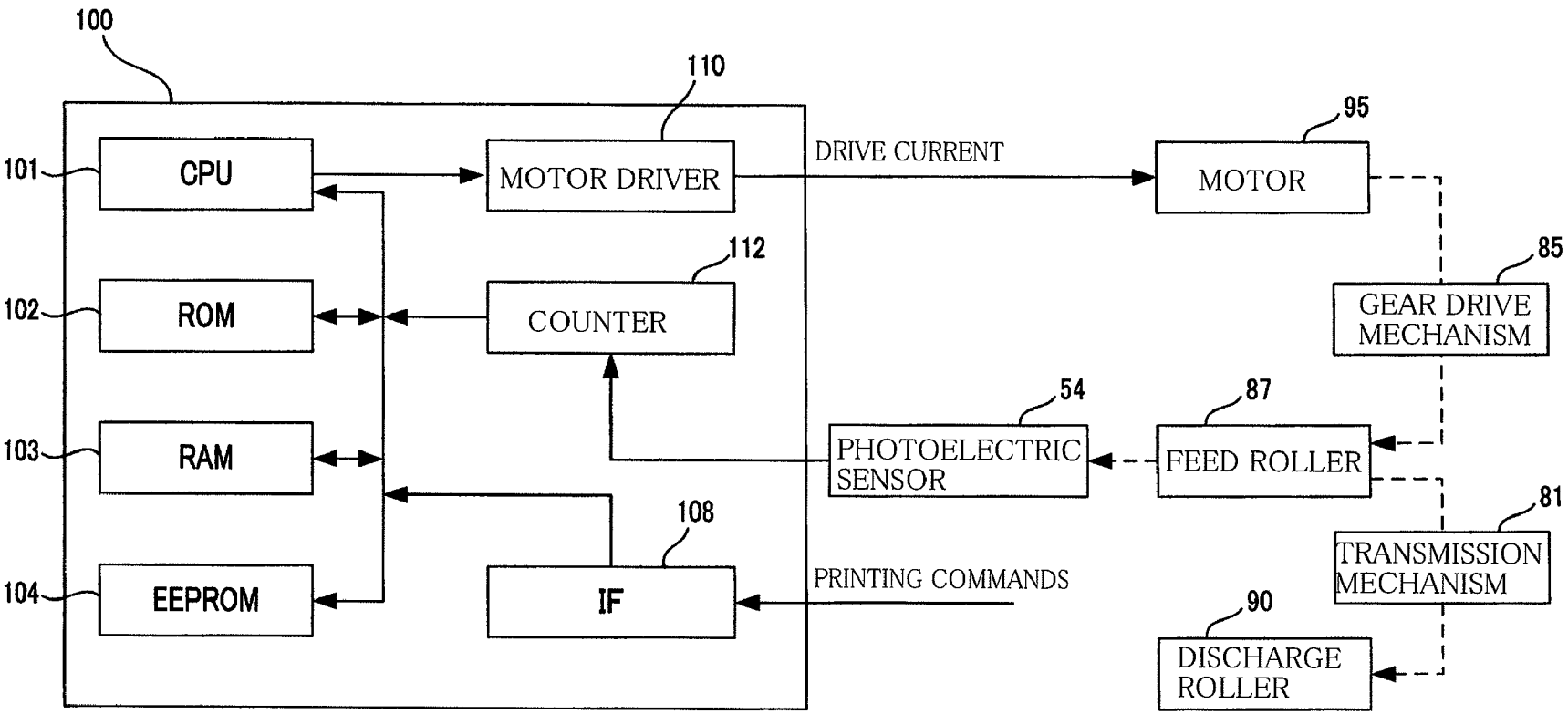
FIG. 4 is a block diagram illustrating major components of the control portion 100.

Referring next to the block diagram of FIG. 4, there will be described major components of the control portion 100 of the multi-function apparatus 1. The control portion 100 includes an obtaining portion, an estimating portion, a subtracting portion, a calculating portion and a comparing portion of the sheet feeding device according to the present embodiment of the invention.

The control portion 100 controls the rotary motions of the feed roller 87 and the discharge roller 90 by the drive motor 95. This control portion 100 incorporates, as major components, a CPU 101 configured to perform various arithmetic operations, a ROM 102, a RAM 103, an EEPROM 104, an interface (I/F) 108, the above indicated motor driver 110, and a counter 112, which are interconnected to each other through an internal bus. In the present embodiment, the control portion 100 is provided to control to control the rotary motions of the feed roller 87 and the discharge roller 90. However, the control portion 100 may be incorporated in a controller provided to control the multi-function apparatus 1.

The interface 108 is provided to receive a recording command and other commands from a host computer (not shown), All commands generated by external devices are received by the control portion 100 through the interface 108.

The EEPROM 104 is capable of storing various data, settings, flags, etc. even while the control portion 100 is in the power-off state. The EEPROM 104 also stores data indicative a first compensating parameter P specific to the feed roller 87, and a second compensating parameter Q specific to the discharge roller 90, which values P, Q have been obtained in advance. The EEPROM 104 functions as a compensating parameter memory.

In the present embodiment, the percent values or ratios of the actual outside diameters of the feed roller 87 and discharger roller 90 with respect to the nominal values is stored in the EEPROM 104, as the first and second compensating parameters P, Q. For example, the percent value of 100.6%) is stored in the EEPROM 104, as the first compensating parameter. It is noted, however, that the required number of digits of the information representing those percent values or ratios tends to large, resulting in a relatively high processing load and a relatively low degree of processing efficiency for writing and reading of the information in and from the EEPROM 104 and for calculating a difference between the first and second compensating parameters P, Q. In this respect, the EEPROM 104 may store information indicating the identification number of one of the seven lines 61-67 which is nearest to the reference line 60. In the example of FIG. 3B, the second line 62 is nearest to the reference line 60. In this case, the EEPROM 104 may store information representing the identification number "2" of the second line 62, and a predetermined rule such as a mathematical equation for obtaining each of the first and second compensating parameters P, Q on the basis of the stored identification number. This arrangement reduces the required capacity of the EEPROM 104, and reduces the load of the CPU 101 to write and read the compensating parameters P, Q in and from the EEPROM 104.

Figure 5:
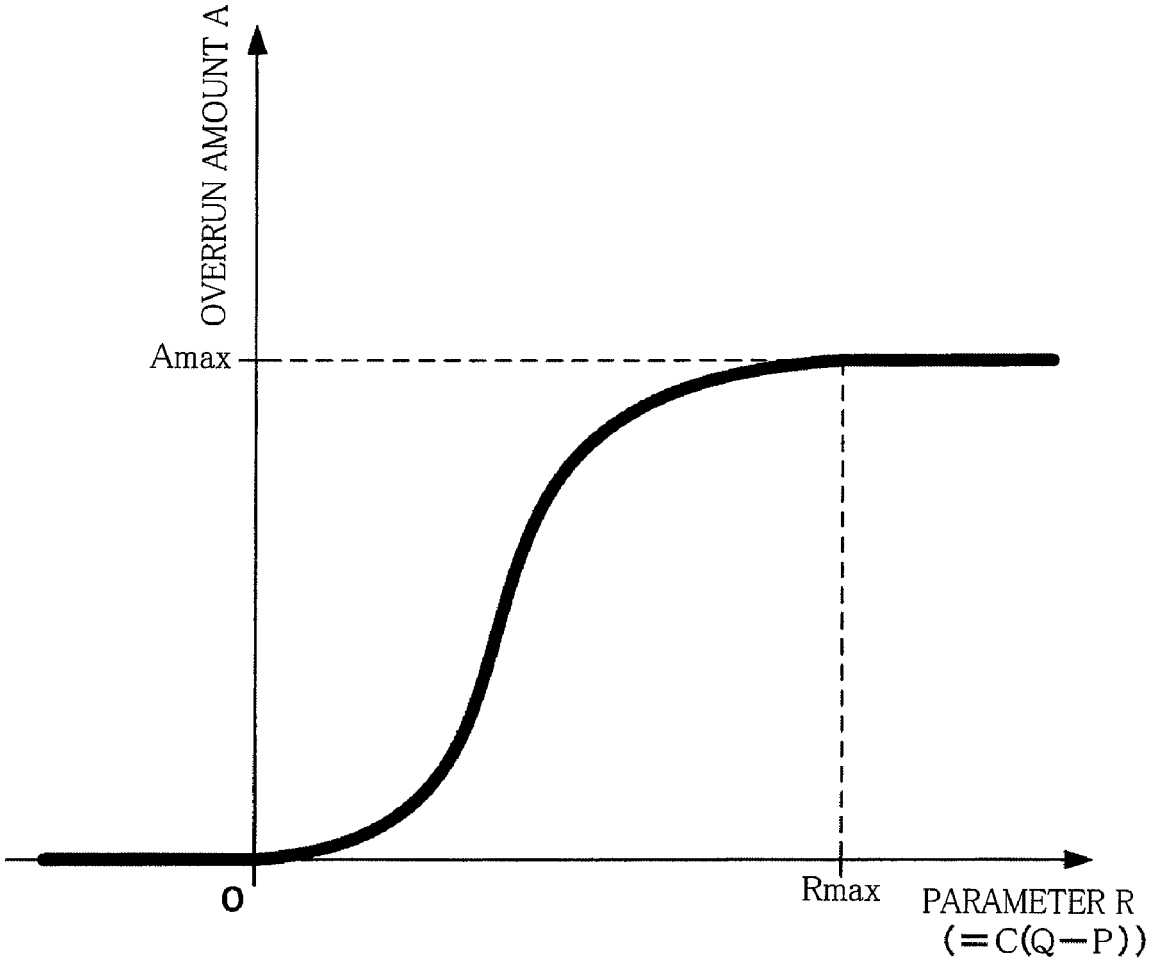
FIG. 5 is a view indicating an overrun amount corresponding to the size of a recording sheet and a difference (Q−P) between the first and second compensating parameters P and Q.

The ROM 102 stores a control program used by the CPU 101 to control the rotary motions of the feed roller 87 and the discharge roller 90. Described more specifically, the ROM 102 stores the control program used by the CPU 101 to execute the control routine illustrated in the flow chart of FIG. 6. The ROM 102 also stores a data table (look-up table) used for adjusting the amount of intermittent feeding of the recording sheet by the feed roller 87. The ROM 102 functions as a correlating data memory. Namely, the data table represents a relationship between an overrun amount A of the recording sheet and a parameter R, which relationship is indicated in the graph of FIG. 5. The overrun amount A will be described in detail by reference to the graph of FIG. 5.

In the graph of FIG. 5, the overrun amount A as represented by the counted number of pulses of the photoelectric sensor 54 is taken along the vertical axis. The overrun amount A is an estimated distance of feeding of the recording sheet when the trailing edge of the recording sheet leaves the pressure nip of the feed roller pair 89 during the intermittent feeding of the recording sheet by the feed roller pair 89 and the discharge roller pair 92. As described above, the overrun of the recording sheet takes place when the tensile force acting on the recording sheet is zeroed or becomes absent when the trailing edge of the recording sheet leaves the pressure nip of the feed roller pair 89. Described in detail, the overrun takes place when the discharge roller 92 and the transmission mechanism 81 which have been deformed due to the tensile force are restored to their original non-deformed states. Accordingly, the overrun amount A changes depending upon the amount or degree of deformation (hereinafter referred to as "deformation amount") of the shaft of the discharge roller 90 and the transmission mechanism 81.

The deformation amount indicated above changes with a distance C of feeding of the recording sheet by both the feed roller pair 89 and the discharge roller pair 92, which distance C is equal to the length of the recording sheet in the feeding direction minus a distance between the feed roller pair 89 and the discharge roller pair 92. The distance C when the A4-size sheet is fed and the distance C when the A3-size sheet is fed, for example, are different from each other. Accordingly, the cumulative deformation amount of the shaft of the discharge roller 90 and the transmission mechanism 81 changes depending upon the distance C. An amount of this change of the deformation amount causes a change of the overrun amount A.

The above-indicated deformation amount changes with a difference (Q−P) between the above-described first and second compensating parameters P, Q, as well as the above-indicated distance C. A difference between the peripheral speeds of the feed roller 87 and the discharge roller 90 decreases with a decrease of the difference (Q−P), and the deformation amount also decreases with the decrease of the difference (Q−P). Conversely, the difference between the peripheral speeds of the feed and discharge rollers 87, 90 increases with an increase of the difference (Q−P), and the deformation amount also increases with the increase of the difference (Q−P). Accordingly, the overrun amount A changes with the deformation amount, that is, with the difference (Q−P).

In the graph of FIG. 5, a value R (parameter R described above with respect to the data table stored in the ROM 102) which is a product of the difference (Q−P) between the first and second compensating parameters P, Q and the distance C is taken along the horizontal axis. This parameter R represents the tensile force acting on the recording sheet at the moment when the recording sheet is fed by the distance C by both the feed roller pair 89 and the discharge roller pair 92, in other words, represents a cumulative difference between the total amounts of intermittent feeding of the recording sheet by the feed roller pair 89 and the discharge roller pair 92. The parameter R reflects three elements consisting of the size of the recording sheet, the first compensating parameter P and the second compensating parameter Q. That is, the graph of FIG. 5 represents a relationship between the parameter R and the overrun amount A of the recording sheet. The data table stored in the ROM 102 represents this relationship between a plurality of values of the parameter R and the corresponding values of the overrun amount A. It is noted that this relationship is obtained on the basis of statistical data obtained by repeated experimentation.

According to the data table used in the present embodiment, the overrun amount A is zero when the parameter R=C(Q−P) is a negative value, that is, when the difference (Q−P) is a negative value, namely, when the peripheral speed of the discharge roller 90 is lower than that of the feed roller 87 so that the tensile force does not act on the recording sheet, whereby the overrun of the recording sheet does not take place when the trailing edge of the recoding sheet leaves the pressure nip of the feed roller pair 89. When the parameter R is a positive value, that is, when the difference (Q−P) is a positive value, namely, when the peripheral speed of the discharge roller 90 is higher than that of the feed roller 87, the overrun amount A is a positive value corresponding to the specific value of the parameter R. It is noted that the deformation amount of the shaft of the discharge roller 90 and the transmission mechanism 81 is limited, that is, has an upper limit above which the discharge roller 90 slips on the recording sheet. Accordingly, the deformation amount is saturated at the upper limit of the deformation amount. Thus, the overrun amount A has an upper limit Amax at an upper limit Rmax of the parameter R which reflects the upper limit of the deformation amount.

The RAM 103 temporarily stores various sorts of data or information when the CPU 101 execute the above-described control program or performs various arithmetic operations.

The motor driver 110 applies a drive current corresponding to the drive signal received from the CPU 101, to the drive motor 95. The drive motor 95 is operated according to the drive current so that the drive motor 95 is operated by the predetermined amount to rotate the feed roller 87 by the predetermined amount.

The counter 112 counts the number of the pulses of the pulse signal generated from the photoelectric sensor 54. The counted number of the pulses is stored in a memory of the counter 112.

The CPU 101 generates the feeding commands for controlling the drive motor 95 according to the program stored in the ROM 102, so that control signals are applied to the motor driver 110 and various other parts of the control portion 100. When the CPU 101 receives the recording command from the host computer (not shown) through the interface 108, the CPU 101 determines the amount of continuous or intermittent feeding of the recording sheet depending upon the received printing command, and applies the drive signal corresponding to the determined amount of feeding to the motor driver 110. Described in detail, before the recording sheet reaches the platen 42, the CPU 101 applies the drive signal to the motor driver 110 for continuously operating the drive motor 95. While the image recording operation is performed on the recording sheet supported by the platen 42, the CPU 101 applies the successive drive signals to the motor driver 110 for intermittently rotating the feed roller 87 to intermittently feed the recording sheet by the predetermined incremental distance. After the image recording operation is terminated, the CPU 101 applies the drive signal to the motor driver 110 for continuously operating the drive motor 95 to continuously feed the recording sheet.

The CPU 101 calculates the amount (angle) and speed of rotation of the feed roller 87 on the basis of the counted number of the pulses of the photoelectric sensor 54 stored in the memory of the counter 112, and the pulse width. The CPU 101 is further configured to detect the position of the recording sheet being fed along the sheet feeding path 23, on the basis of the output signal of the sheet sensor 32 disposed adjacent to the sheet feeding path 23, and the number of the pulses of the photoelectric sensor 54 counted after the output signal is received.

Referring to the flow chart of FIG. 6, there will be described the control routine executed by the control portion 100 to adjust the commanded amount of feeding of the recording sheet by the feed roller pair 89 and the discharger roller pair 92, and the method of compensating the amount of feeding of the recording sheet. This control routine is initiated when the recording command is received by the control portion 100.

When the recording command is received by the control portion 100 through the interface 108, the control routine is initiated with step S1 in which the CPU 101 reads out the first compensating parameter P and the second compensating parameter Q from the EEPROM 104. The compensating parameters A and Q which have been read out are temporarily stored in a temporary data memory in the form of the RAM 103.

Then, the control flow goes to step S2 in which the CPU 101 subtracts the first compensating parameter P from the second compensating parameter Q. The difference (Q−P) obtained in this step S2 is temporarily stored in the RAM 103.

The control flow then goes to step S3 in which the CPU 101 calculates the above-described parameter R, which is the product of the difference (Q−P) stored in the ram 103 and the above-described distance C. The distance C can be obtained on the basis of the size of the recording sheet received together with the recording command, or size information set in the printer portion 2, and the distance between the feed roller 87 and the discharge roller 90.

The step S3 is followed by step S4 in which the CPU 101 obtains the overrun amount A on the basis of the calculated parameter R and according to the data table stored in the ROM 102.

Then, the control flow goes to step S5 in which the CPU 101 determines whether the recording sheet has been fed to a predetermined recording start position, more precisely, whether the leading end of a predetermined image recording area of the recording sheet has been moved to the predetermined recording start position at which the image recording operation within the predetermined image recording area is started by the image recording unit 24. This determination as to whether the recording sheet has been fed to the predetermined recording start position can be made by accurately detecting the present position of the recording sheet on the basis of the output signal of the sheet sensor 32 and the number of pulses of the photoelectric sensor 54 counted by the counter 112. After the recording sheet has been fed to the recording start position, the recording sheet is intermittently fed by the predetermined incremental distance F for each feeding action, for performing the image recording operation on the recording sheet.

After the recording sheet has been fed to the recording start position, that is, if an affirmative determination ("Yes") is obtained in the step S5, the control flow goes to step S6 in which the CPU 101 obtains the incremental feeding amount F of the next feeding command. The feeding amount F is included in the feeding command for feeding the recording sheet after each line of image is recorded, that is, included in the feeding command generated next. The feeding amount F is represented by the number of the pulses of the photoelectric sensor 54 counted by the counter 112 (shown in FIG. 4), so that the recording sheet is fed by the feeding amount F by operating the drive motor 95 until the number of the pulses counted by the counter 112 has reached the value corresponding to the feeding amount F. In the present embodiment, the feeding amount F is the incremental feeding distance by which the recording sheet is fed in each of the intermittent feeding actions. The incremental feeding amount or distance F is determined depending upon a selected one of image resolution values available and a selected one of different recording modes available. The desired image resolution value and recording mode are selected according to information received by the control portion 100 together with the recording command.

The step S6 is followed by step S7 in which the CPU 101 obtains a remaining feeding amount L of the recording sheet required for the trailing edge to leave the feed roller pair 89. Like the feeding amount F, the remaining feeding amount L is represented by the number of the pulses of the photoelectric sensor 54 counted by the counter 112. In the present embodiment, the remaining feeding amount L is calculated on the basis of the size information of the recording sheet received together with the recording command, the output signal of the sheet sensor 32 and the counted number obtained by the counter 112. Described in detail, the remaining feeding amount L can be calculated by subtracting the total feeding distance of the recording sheet after the leading edge has passed the feed roller pair 89, from the length of the recording sheet in the feeding direction. Alternatively, the remaining feeding amount L can be calculated by subtracting the cumulative or total feeding distance of the recording sheet after the trailing edge has left the feed roller pair 89, from the distance between the sheet sensor 32 to the feed roller pair 89. The total feeding distance is obtained by the number of the pulses counted by the counter 112 after the trailing edge of the recording sheet has left the feed roller pair 89. Since the latter method is more accurate than the former method, it is desirable to calculate the remaining feeding amount L by the former method before the trailing edge of the recording sheet has left the sheet sensor 32, and by the latter method after the trailing edge has left the sheet sensor 32.

The control flow then goes to step S8 in which the CPU 101 compares the remaining feeding amount L obtained in step S7 and the feeding amount F obtained in step S6, to estimate whether the trailing edge of the recording sheet leaves the feed roller pair 89 by the next incremental feeding action by the feeding amount F. Namely, if the remaining feeding amount L is larger than the feeding amount F, that is, if an affirmative determination ("Yes") is obtained in step S8, it is estimated that the trailing end portion of the recording sheet is still nipped by the feed roller pair 89 after the next incremental feeding action by the feeding amount F. If the remaining feeding amount L is not larger than the feeding amount F, that is, if a negative determination ("No") is obtained in step S8, it is estimated that the trailing edge of the recording sheet leaves the feed roller pair 89 during the next incremental feeding action.

If the affirmative determination ("Yes") is obtained in the step S8, the control flow goes to step S9 in which the recording sheet is fed by the incremental feeding amount F after one line of image is recorded on the recording sheet. In this case, the control flow goes back to step S6 and the subsequent steps.

If the negative determination ("No") is obtained in the step S8, this indicates a high possibility that the trailing edge of the recording sheet leaves the feed roller pair 89 during the next incremental feeding action. In this case, the control flow goes to step S10 in which the recording sheet is fed by a distance (F−A) which is equal to the predetermined incremental feeding distance F minus the overrun amount A obtained in the above-described step S4. Then, step S11 is implemented to record the remaining image on the recording sheet. After the remaining image is recorded on the recording sheet, the recording sheet is discharged or ejected by the discharge roller pair 92.

As described above, the present embodiment of this invention is configured such that when it is estimated that the trailing edge of the recording sheet leaves the feed roller pair 89 during the next feeding action by the predetermined incremental feeding distance F, the recording sheet is fed in the next feeding action by the feeding amount (F−A) which is obtained by subtracting the previously calculated overrun amount A from the predetermined incremental feeding amount F. Accordingly, the recording sheet is actually fed in the next feeding action by a distance substantially equal to the predetermined or nominal feeding amount F. The recording sheet would be otherwise overrun by the overrun amount A if the feed roller 87 and the discharge roller 90 were commanded to feed the recording sheet by the nominal feeding amount F when the trailing edge of the recording sheet leaves the feed roller pair 89. Accordingly, the recording sheet will not be actually overrun when the trailing edge leaves the feed roller pair 89, making it possible to effectively prevent the conventionally experienced hunting phenomenon due to the overrun of the recording sheet at the end of the recording operation by the intermittent feeding actions of the recording sheet.

In the illustrated embodiment, the ratio or percent value of the actual outside diameter of the feed roller 87 to the nominal value is used as the first compensating parameter P, while the ratio or percent value of the actual outside diameter of the discharge roller 90 to the nominal value is used as the second compensating parameter Q. However, the first and second compensating parameters P, Q are not limited to these ratios or percent values. or instance, other values relating to the outside diameters and perimeters of the feed roller 87 and discharge roller 90, or any values proportional to those values may be used as the first and second compensating parameters P, Q. That is, the first and second compensating parameters P, Q may be any values a difference between which is proportional to a difference between the actual amounts of feeding of the recording sheet by the feed roller 87 and the discharge roller 90.

In the steps S1 and S2 in the illustrated embodiment, the first and second compensating parameters P and Q are obtained, and the difference (Q−P) between these compensating parameters P, Q. However, the actual amount of feeding of the recording sheet by the feed roller 87 (first feeding amount) and the actual amount of feeding of the recording sheet by the discharge roller 90 (second feeding amount) may be obtained to calculate a difference between these two actual feeding amounts. The actual feeding amount of the feed roller 87 is theoretically obtained by multiplying the radius of the feed roller 87 (first radius) by an amount of rotation of the feed roller 87 (first amount of rotation) corresponding to the commanded feeding amount, and the actual feeding amount of the discharge roller 90 is theoretically obtained by multiplying the radius of the discharge roller 90 (second radius) by an amount of rotation of the discharge roller 90 (second amount of rotation) corresponding to the commanded feeding amount. In this case, too, the data table representing the relationship between the overrun amount A and the difference between the feeding amounts of the feed and discharge rollers 87, 90 is required to be stored in the ROM 102. In this case, however, it is required to perform a cumbersome operation to actually rotate the feed roller 87 and the discharge roller 90 and counting the number of pulses of the photoelectric sensor 54. It is desirable to obtain the data table representing the relationship between the overrun amount A and the parameter R=C(Q−P), in view of the fact that the difference (Q−P) between the first and second compensating parameters P, Q obtained in the illustrated embodiment is principally or theoretically proportional to the difference between the amounts of feeding of the recording sheet by the feed and discharge rollers 87, 90.

Although the feed roller 87 and the discharge roller 90 have the same peripheral speed in the illustrated embodiment, the illustrated embodiment may be modified such that the peripheral speed of the discharge roller 90 is made higher than that of the feed roller 87, for preventing deflection of the recording sheet during intermittent feeding of the recording sheet by both of the feed and discharge rollers 87, 90. The principle of the present invention to prevent the overrun of the recording sheet is applicable to this modified embodiment, as long as the modified embodiment also uses the relationship between the overrun amount A and the parameter R which is the product of the difference (P−Q) and the distance C, to prevent the overrun.

While the illustrated embodiment uses the data table representing the relationship between the overrun amount A of the recording sheet and the parameter R, the illustrated embodiment may be modified such that a plurality of relationships between the overrun amount A and the difference (Q−P) are prepared for respective different sizes of the recording sheet, so that one of the relationships which corresponds to the selected one of the different sizes of the recording sheet is selected to prevent the overrun of the recording sheet.

What is claimed is:

1. A sheet feeding device for intermittently feeding a sheet member on the basis of a commanded feeding amount comprised in each of successively generated feeding commands, said sheet feeding device comprising:

a first feeding roller rotated by a first amount of rotation corresponding to the commanded feeding amount;

a second feeding roller disposed downstream of the first feeding roller in a feeding direction of the sheet member and rotated by a second amount of rotation corresponding to the commanded feeding amount;

an obtaining portion configured to obtain an overrun amount of the sheet member immediately after a trailing edge of the sheet member has left the first feeding roller, on the basis of a difference obtained by subtracting a first feeding amount, which is obtained from a product of a first radius and the first amount of rotation of the first feeding roller, from a second feeding amount, which is obtained from a product of a second radius and the second amount of rotation of the second feeding roller;

an estimating portion configured to estimate whether the trailing edge of the sheet member leaves the first feeding roller during feeding of the sheet member according to a next one of the successively generated feeding command; and a subtracting portion configured to subtract the overrun amount of the sheet member obtained by the obtaining portion, from the next commanded feeding amount comprised in the next feeding command, when the estimating portion estimates that the trailing edge of the sheet member leaves the first feeding roller, wherein the estimating portion comprises:

a calculating portion configured to calculate a remaining feeding amount of the sheet member required for the trailing edge to leave the first feeding roller; and a comparing portion configured to compare the remaining feeding amount calculated by the calculating portion with the next commanded feeding amount comprised in the next feeding command, and wherein the estimating portion is configured to estimate that the trailing edge of the sheet member leaves the first feeding roller when the comparing portion determines that the remaining feeding amount is less than the next commanded feeding amount.

2. The sheet feeding device according to claim 1, further comprising a common drive power source for rotating the first and second feeding rollers.

3. The sheet feeding device according to claim 2, wherein the second feeding amount is equal to or greater than the first feeding amount.

4. The sheet feeding device according to claim 1, further comprising a first driven roller rotated by the first feeding roller in pressing contact with the first feeding roller, and a second driven roller rotated by the second feeding roller in pressing contact with the second feeding roller.

5. An image recording apparatus comprising a sheet feeding device as defined in claim 1 and an image recording unit, and configured to perform an image recording operation on the sheet member fed by the sheet feeding device, wherein said first and second feeding rollers are disposed on respective upstream and downstream sides of the image recording unit.

6. The image recording apparatus according to claim 5, wherein the image recording unit is configured to perform an ink jet type image recording operation by ejecting droplets of ink.

7. The image recording apparatus according to claim 5, which is of an ink jet type configured to perform an ink jet type image recording operation by ejecting droplets of ink.

8. A sheet feeding device for intermittently feeding a sheet member on the basis of a commanded feeding amount comprised in each of successively generated feeding commands, said sheet feeding device comprising:

a first feeding roller rotated by a first amount of rotation corresponding to the commanded feeding amount;

a second feeding roller disposed downstream of the first feeding roller in a feeding direction of the sheet member and rotated by a second amount of rotation corresponding to the commanded feeding amount;

an obtaining portion configured to obtain an overrun amount of the sheet member immediately after a trailing edge of the sheet member has left the first feeding roller, on the basis of a difference obtained by subtracting a first feeding amount, which is obtained from a product of a first radius and the first amount of rotation of the first feeding roller, from a second feeding amount, which is obtained from a product of a second radius and the second amount of rotation of the second feeding roller;

an estimating portion configured to estimate whether the trailing edge of the sheet member leaves the first feeding roller during feeding of the sheet member according to a next one of the successively generated feeding command;

a subtracting portion configured to subtract the overrun amount of the sheet member obtained by the obtaining portion, from the next commanded feeding amount comprised in the next feeding command, when the estimating portion estimates that the trailing edge of the sheet member leaves the first feeding roller; and a compensating parameter memory storing a first compensating parameter, which is determined according to an outside diameter of the first feeding roller and which is used to compensate the first amount of rotation for coincidence of the first feeding amount with the commanded feeding amount, and a second compensating parameter, which is determined according to an outside diameter of the second feeding roller and which is used to compensate the second amount of rotation for coincidence of the second feeding amount with the commanded feeding amount, wherein the obtaining portion obtains the overrun amount of the sheet member on the basis of a difference obtained by subtracting the first compensating amount from the second compensating amount.

9. The sheet feeding device according to claim 8, further comprising a correlating data memory storing a relationship between the difference obtained by subtracting the first compensating amount from the second compensating amount, and the overrun amount of the sheet member, and wherein the obtaining portion obtains the overrun amount of the sheet member according to the relationship stored in the correlating data memory.

10. The sheet feeding device according to claim 8, further comprising a common drive power source for rotating the first and second feeding rollers.

11. The sheet feeding device according to claim 8, wherein the second feeding amount is equal to or greater than the first feeding amount.

12. The sheet feeding device according to claim 8, further comprising a first driven roller rotated by the first feeding roller in pressing contact with the first feeding roller, and a second driven roller rotated by the second feeding roller in pressing contact with the second feeding roller.

13. A method of compensating an amount of feeding of a sheet member which is intermittently fed on the basis of a commanded feeding amount comprised in each of successively generated feeding commands, by a first feeding roller rotated by a first amount of rotation corresponding to the commanded feeding amount, and a second feeding roller disposed downstream of the first feeding roller as viewed in a feeding direction of the sheet member and rotated by a second amount of rotation corresponding to the commanded feeding amount, said method comprising:

a step of obtaining an overrun amount of the sheet member immediately after a trailing edge of the sheet member has left the first feeding roller, on the basis of a difference obtained by subtracting a first feeding amount, which is obtained from a product of a first radius and the first amount of rotation of the first feeding roller, from a second feeding amount, which is obtained from a product of a second radius and the second amount of rotation of the second feeding roller;

a step of estimating whether the trailing edge of the sheet member leaves the first feeding roller during feeding of the sheet member according to a next one of the successively generated feeding command; and a step of subtracting the overrun amount of the sheet member obtained in the obtaining step, from the next commanded feeding amount comprised in the next feeding command, when it is estimated in the second step that the trailing edge of the sheet member leaves the first feeding roller, wherein the estimating step comprises:

calculating a remaining feeding amount of the sheet member required for the trailing edge to leave the first feeding roller; and comparing the remaining feeding amount calculated by the calculating portion with the next commanded feeding amount comprised in the next feeding command, and wherein it is estimated that the trailing edge of the sheet member leaves the first feeding roller, when it is determined that the remaining feeding amount is less than the next commanded feeding amount.

14. A method of compensating an amount of feeding of a sheet member which is intermittently fed on the basis of a commanded feeding amount comprised in each of successively generated feeding commands, by a first feeding roller rotated by a first amount of rotation corresponding to the commanded feeding amount, and a second feeding roller disposed downstream of the first feeding roller as viewed in a feeding direction of the sheet member and rotated by a second amount of rotation corresponding to the commanded feeding amount, said method comprising:

a step of obtaining an overrun amount of the sheet member immediately after a trailing edge of the sheet member has left the first feeding roller, on the basis of a difference obtained by subtracting a first feeding amount, which is obtained from a product of a first radius and the first amount of rotation of the first feeding roller, from a second feeding amount, which is obtained from a product of a second radius and the second amount of rotation of the second feeding roller;

a step of estimating whether the trailing edge of the sheet member leaves the first feeding roller during feeding of the sheet member according to a next one of the successively generated feeding command; and a step of subtracting the overrun amount of the sheet member obtained in the obtaining step, from the next commanded feeding amount comprised in the next feeding command, when it is estimated in the second step that the trailing edge of the sheet member leaves the first feeding roller; and a step of storing a first compensating parameter, which is determined according to an outside diameter of the first feeding roller and which is used to compensate the first amount of rotation for coincidence of the first feeding amount with the commanded feeding amount, and a second compensating parameter, which is determined according to an outside diameter of the second feeding roller and which is used to compensate the second amount of rotation for coincidence of the second feeding amount with the commanded feeding amount, wherein the obtaining step comprises obtaining the overrun amount of the sheet member on the basis of a difference obtained by subtracting the first compensating amount from the second compensating amount.

* * * * *